US007171896B2

(12) United States Patent
Steffen et al.

(10) Patent No.: US 7,171,896 B2
(45) Date of Patent: Feb. 6, 2007

(54) APPARATUS FOR DECORATING STIFF OBJECTS BY SCREEN PRINTING

(75) Inventors: Volker Steffen, Herford (DE); Horst Heidenreich, Kirchlengern (DE)

(73) Assignee: Werner Kammann Maschinenfabrik GmbH, Bünde (DE)

( * ) Notice: Subject to any disclaimer, the term of this patent is extended or adjusted under 35 U.S.C. 154(b) by 123 days.

(21) Appl. No.: 11/023,324

(22) Filed: Dec. 27, 2004

(65) Prior Publication Data

US 2005/0223918 A1 Oct. 13, 2005

(30) Foreign Application Priority Data

Apr. 8, 2004 (DE) ..... 10 2004 018 189

(51) Int. Cl.
*B41F 15/08* (2006.01)
*B41F 15/26* (2006.01)

(52) U.S. Cl. ..... 101/126; 101/123; 101/41

(58) Field of Classification Search ..... 101/114, 101/123, 126, 127, 127.1, 129, 41, 43, 44, 101/474

See application file for complete search history.

(56) References Cited

U.S. PATENT DOCUMENTS 4,919,043 A * 4/1990 Bubley et al. ..... 101/123
4,958,559 A * 9/1990 Bubley et al. ..... 101/123
5,265,533 A * 11/1993 Svantesson et al. ..... 101/123
6,082,256 A 7/2000 Hellmeier et al.

FOREIGN PATENT DOCUMENTS

DE 24 02 386 B1 4/1975

* cited by examiner

*Primary Examiner*—Leslie J. Evanisko
(74) *Attorney, Agent, or Firm*—Akin Gump Strauss Hauer & Feld, LLP

(57) ABSTRACT

In an apparatus for decorating stiff articles using a screen printing process, an object carried by an object carrier and the stencil are advanced synchronously along a transport path during a printing operation. A doctor co-operable with the stencil is movable in an opposite relationship to the direction of movement of the stencil and the object. In the region of the at least one screen printing station is a transport screw with at least one screw flight as a drive for the object carrier, which is in engagement with the screw flight of the screw. During a printing operation the object carrier with object, on the one hand, and the stencil, on the other hand, pass synchronously through an acceleration phase and a deceleration phase. The printing stroke of the stencil is less than the total stroke thereof in the direction of movement of the object carrier.

8 Claims, 8 Drawing Sheets

APPARATUS FOR DECORATING STIFF OBJECTS BY SCREEN PRINTING

BACKGROUND OF THE INVENTION

The invention concerns an apparatus for decorating stiff objects by screen printing.

A form of apparatus for decorating, such as printing, inherently stiff objects using screen printing provides that, during the decorating or printing operation, the object to be printed upon is carried by an object carrier. The object on the carrier and at least one screen printing stencil are advanced synchronously along a transport path while a doctor co-operable with the stencil is movable in an opposite relationship to the direction of movement of the object and the stencil. Thus, an apparatus of that nature, which is to be found for example in German published patent application DE-OS 24 02 386, provides that the carrier and the object carried thereby are moved during the transport phase and also during the printing phase on a double chain which circulates in a vertical plane at a constant speed.

Although that apparatus represented a significant advance, in particular in terms of its output and efficiency, it nonetheless requires special items of equipment for introducing the objects into the continuously moving carriers intended to carry them, and for again removing the decorated objects from the carriers. Furthermore, in many cases it was found that that apparatus was not able to satisfy the requirements, which are usually imposed nowadays in terms of the quality of the decoration or printed image produced on the respective objects. It seems that this is due in particular to the fact that the double chain carrying the carriers and the objects thereon involves a certain play, even if minimal, which imposes certain limitations on accuracy of the alignment between the object and the screen printing stencil, such alignment being crucial to the quality of the print image.

Consideration may also be given to U.S. Pat. No. 6,082,256, disclosing an apparatus for printing on objects, in which holders, which pass along fixed guides, for carrying the objects are transported by a screw along a transport path defined by the guides. Using a screw as the drive in this case permits such accurate alignment of the objects in relation to the printing station where printing is applied to the objects that, when using rotary printing, it is possible to achieve in each respective printing station precise synchronization between the constant peripheral speed of the printing cylinder, on the one hand, and the linear speed of the object to be printed upon, which is constant in the region of the respective printing station, on the other hand.

The apparatus of U.S. Pat. 6,082,256 is also equipped with screen printing stations. It will be noted, however, that the operation of printing on the objects, which in this case involve CDs, is effected when they are stationary and the doctor is arranged to be transversely displaceable with respect to the direction of transport movement of the objects. Therefore, alignment of the stopped object with the screen printing stencil, which is also stopped, does not constitute any problems here. That mode of operation admittedly means that the screen printing stencil takes up a small amount of space, but in this case the residence time of each respective object in the screen printing stations is markedly longer than the residence time in the rotary printing stations. This means that the output of the apparatus generally is governed by the residence time of each respective object in the station in which the printing operation requires the longest period of time. Accordingly, it is not possible to make full use of the efficiency of the rotary printing stations, as the residence time of the respective objects in the screen printing stations is the factor that determines the output and thus the efficiency of the apparatus.

BRIEF SUMMARY OF THE INVENTION

An object of the present invention is to design an apparatus for decorating inherently stiff objects by screen printing, so that the disadvantages of the above-discussed prior machines can be at least partially alleviated.

Another object of the invention is to provide an apparatus for decorating stiff objects by screen printing, which is capable of achieving an increase in the throughput in at least one screen printing station thereof.

Yet another object of the invention is to provide an apparatus for decorating objects by screen printing, having a plurality of printing stations which are exclusively or predominantly screen printing stations, while making it possible to achieve an effective throughput of objects in the screen printing stations.

A still further object of the present invention is to provide an apparatus for printing on inherently stiff objects by screen printing which, while permitting a good throughput of said objects, is capable of producing decoration or a print image of a quality which at least complies with the standards usually adopted nowadays.

In accordance with the principles of the present invention the foregoing and other objects are attained by an apparatus for decorating or printing on inherently stiff objects using at least a screen printing process. During a printing operation, an object carried by an object carrier and at least one screen printing stencil are advanced synchronously along a transport path. A doctor co-operable with the screen printing stencil is movable in an opposite relationship to the direction of movement of the stencil and the object. At least in the region of at least one screen printing station the apparatus has a transport screw with at least one screw flight as a drive for the object carrier. The object carrier is operatively engaged with the at least one screw flight. The apparatus further includes at least one drive transmission as a drive for the screen printing stencil. The drive for the object carrier and the drive for the screen printing stencil are so designed and actuatable that, during a printing operation, an object carrier with an object and a screen printing stencil pass synchronously through at least an acceleration phase and a deceleration phase. The printing stroke movement of the screen printing stencil is less than the total stroke movement thereof in the direction of movement of the object carrier.

As will be seen from the description hereinafter of a preferred embodiment of an apparatus according to the invention, besides the printing operation being performed during the transport movement of the object, the fact that a substantial part of the printing operation is implemented during the acceleration phase and the deceleration phase in the movement of the screen printing stencil and the object also affords a marked reduction in the amount of time required for the overall printing procedure. Making use of a part of the acceleration phase and the deceleration phase of the printing stoke movement, to carry out the actual printing operation, permits a markedly shorter total stroke movement in the transport direction, and accordingly also a correspondingly shorter return stroke movement on the part of the screen printing stencil and also the doctor co-operable therewith, with the above-mentioned consequence of saving time in the overall decorating or printing cycle. As the screen printing cycle generally performs a reciprocating movement and as the printing operation is effected during the stroke movement in the transport direction, acceleration and deceleration phases during the movements of the screen printing stencil are inevitable.

In many cases, operational requirements in the respective stations adjacent to the screen printing station means that an object, on reaching the screen printing station, must in any case first experience an acceleration effect and later a deceleration effect, so that the sequence of movements of the object carrier with its object in the region of the screen printing station fits seamlessly into the general movements involved.

It will be appreciated that the decorating or printing procedure can take place in such a way that, between the acceleration phase and the deceleration phase, there is a period of time during which the stencil and the object are moving at a constant speed. That will apply in regard to the majority of situations of use, in which respect the phase of movement at a constant speed can constitute a proportion of between 40 and 45% of the total printing stroke movement, that is to say including the acceleration phase and the deceleration phase.

As a portion of the acceleration phase and the deceleration phase respectively is put to use for the decorating or printing operation on an object, what may be referred to as the over-distance, that is to say the respective remaining distance in the transport direction which the stencil covers prior to the commencement of the printing operation, that is to say for example before the doctor is applied to the stencil, on the one hand, and after termination of the printing operation, that is to say for example after the doctor is lifted off the stencil, on the other hand, is shorter than would be the case if the printing operation were implemented exclusively at a constant speed of movement of the stencil. Thus, the acceleration phase would be concluded prior to the commencement of printing and the deceleration phase would commence only after the end of the printing operation. The shorter over-distances involved in that respect also contributes to shortening the distance by which the stencil is to be moved in the transport direction and thus also during the return stroke movement to resume the starting position.

The length of the over-distance and therewith the respective length of the distances covered during the acceleration phase and the deceleration phase, respectively, by the stencil depends predominantly on requirements in terms of printing procedure, as the printing operation generally cannot begin from a stopped condition or be ended only in the stopped condition. The settings and conditions which are to be observed to achieve a good quality in terms of the decoration or print applied to the object, for example in respect of acceleration, deceleration, speed and adequate distribution of the printing ink are aspects and factors which can be readily established in the course of setting up the apparatus, possibly entailing the implementation of some test print runs, which would be necessary in any case, in setting up an apparatus for a decorating or printing operation.

Furthermore, the oppositely directed movement of the doctor also contributes to reducing the stroke motion of the screen printing stencil and thus the amount of space that a screen printing station using such a stencil requires.

It will be further appreciated that a combination of the above-outlined measures according to the invention affords an increase in output and efficiency, which in the best-case scenarios can be over 80% in comparison with prior screen printing stations.

In accordance with a preferred feature of the invention during a printing operation, between the acceleration phase and the deceleration phase, the apparatus is controlled in such a way as to perform a phase in which the object carriers with the respective object carried thereby and the screen printing stencil are moved synchronously at a constant speed.

In another preferred feature the apparatus has a drive for rotating the transport screw at a constant speed.

A further preferred feature of the invention provides that the apparatus has a cam for driving the screen printing stencil, the cam being connected drivingly by a transmission to the at least one screen printing stencil.

In accordance with another preferred feature, the apparatus according to the invention includes a swing lever to which reciprocating movements are transmitted by the above-mentioned cam. The swing lever is drivingly connected to at least one carriage carrying a screen printing stencil. Preferably, the apparatus has a thrust rod for making the connection between the swing lever and the respective carriage carrying the screen printing stencil. The swing lever can preferably be connected to the thrust rod intermediate the ends thereof, and each end of the thrust rod can be connected to a respective carriage.

Preferably, the drive for the doctor co-operable with the stencil is derived from the drive for the stencil.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
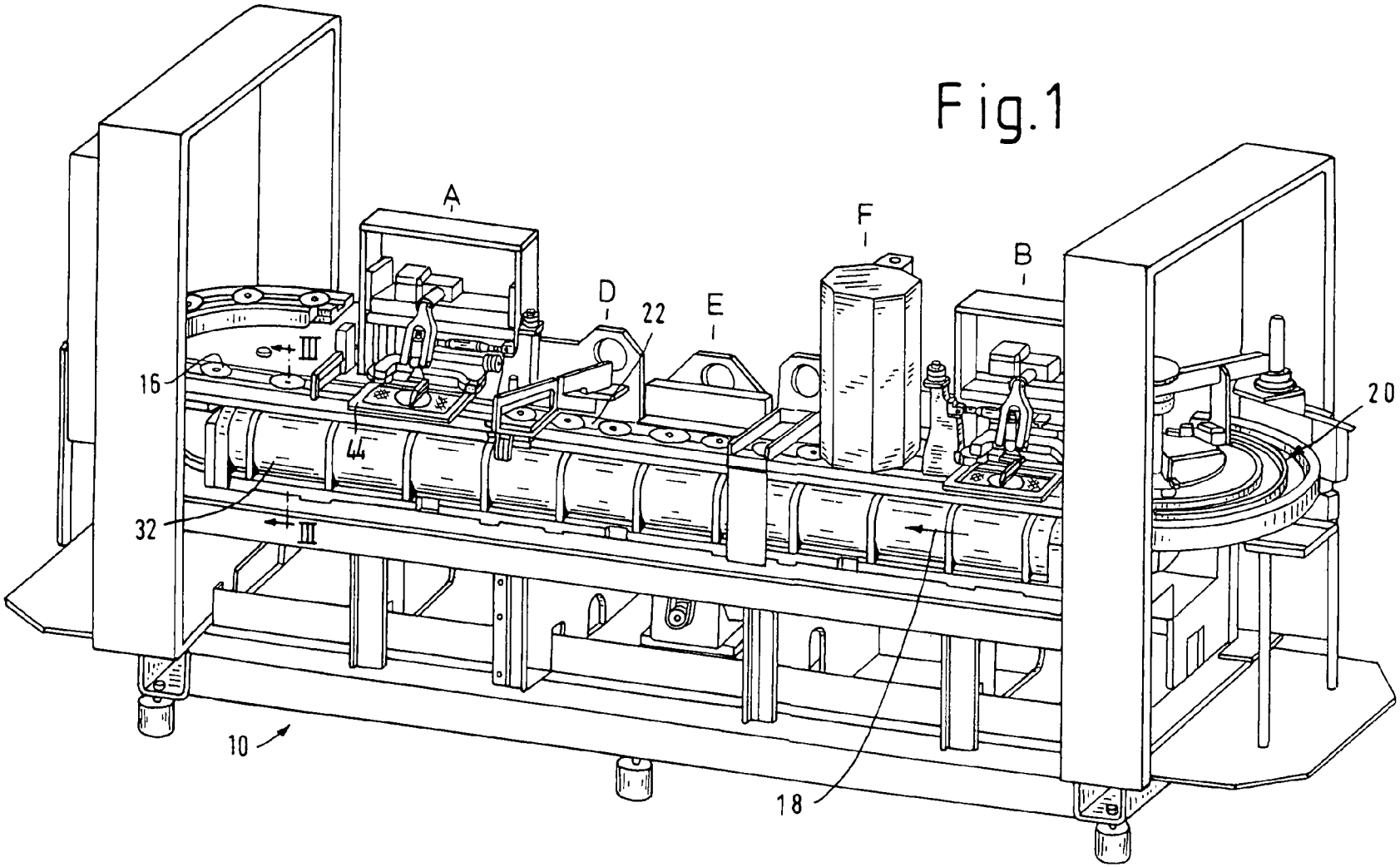
FIG. 1 is a diagrammatic perspective view of an apparatus according to the invention in the form of a printing machine for decorating objects in the form of CDs.
Figure 2:
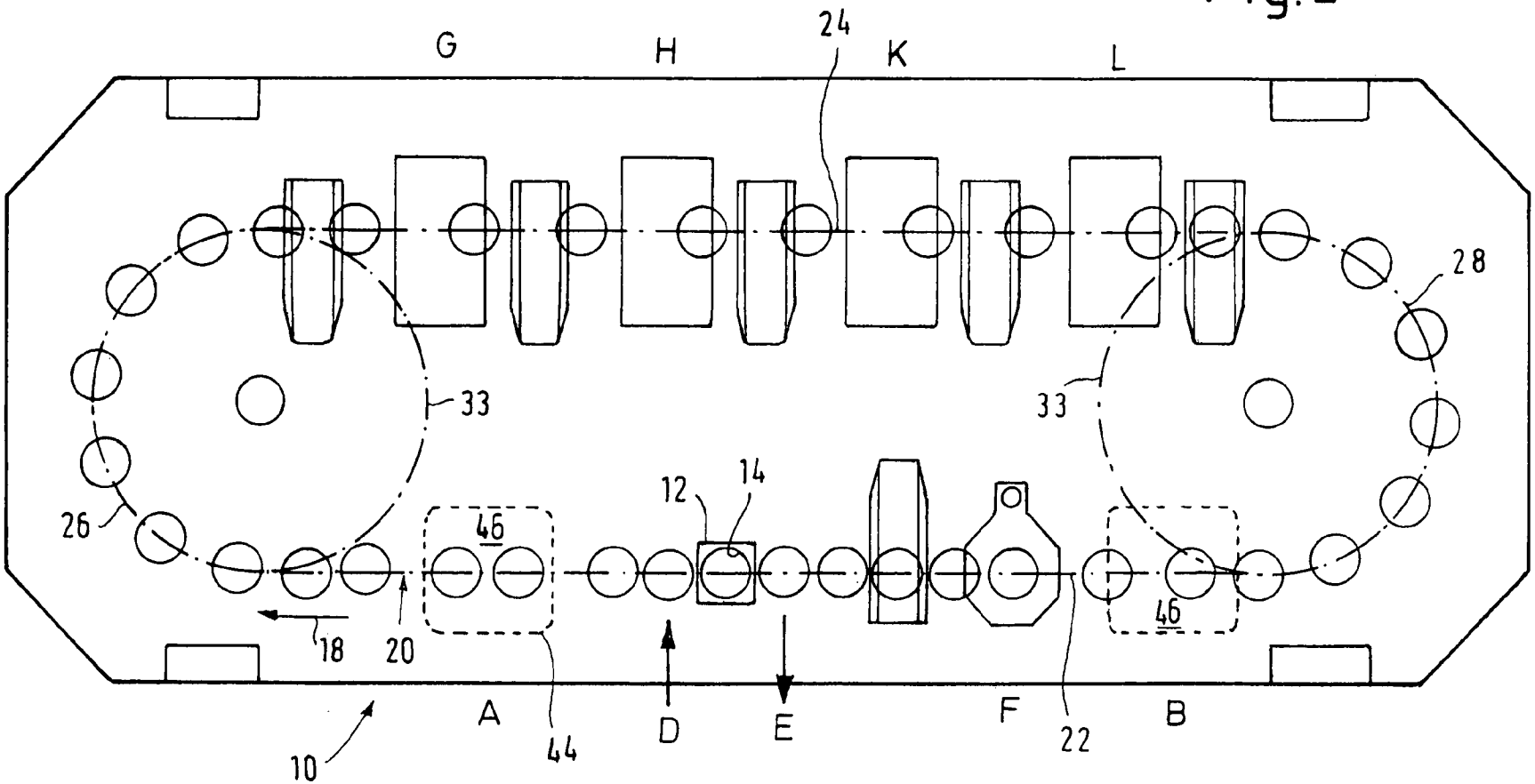
FIG. 2 is a highly diagrammatic plan view of the machine of FIG. 1.

Reference will first be made to FIGS. 1 and 2 showing the fundamental structure of an apparatus for decorating inherently stiff objects using at least the screen printing process, in the form of a printing machine indicated generally at 10 which serves for applying printing to flat objects, for example CDs as illustrated here, or credit cards or similar articles.

Figure 3:
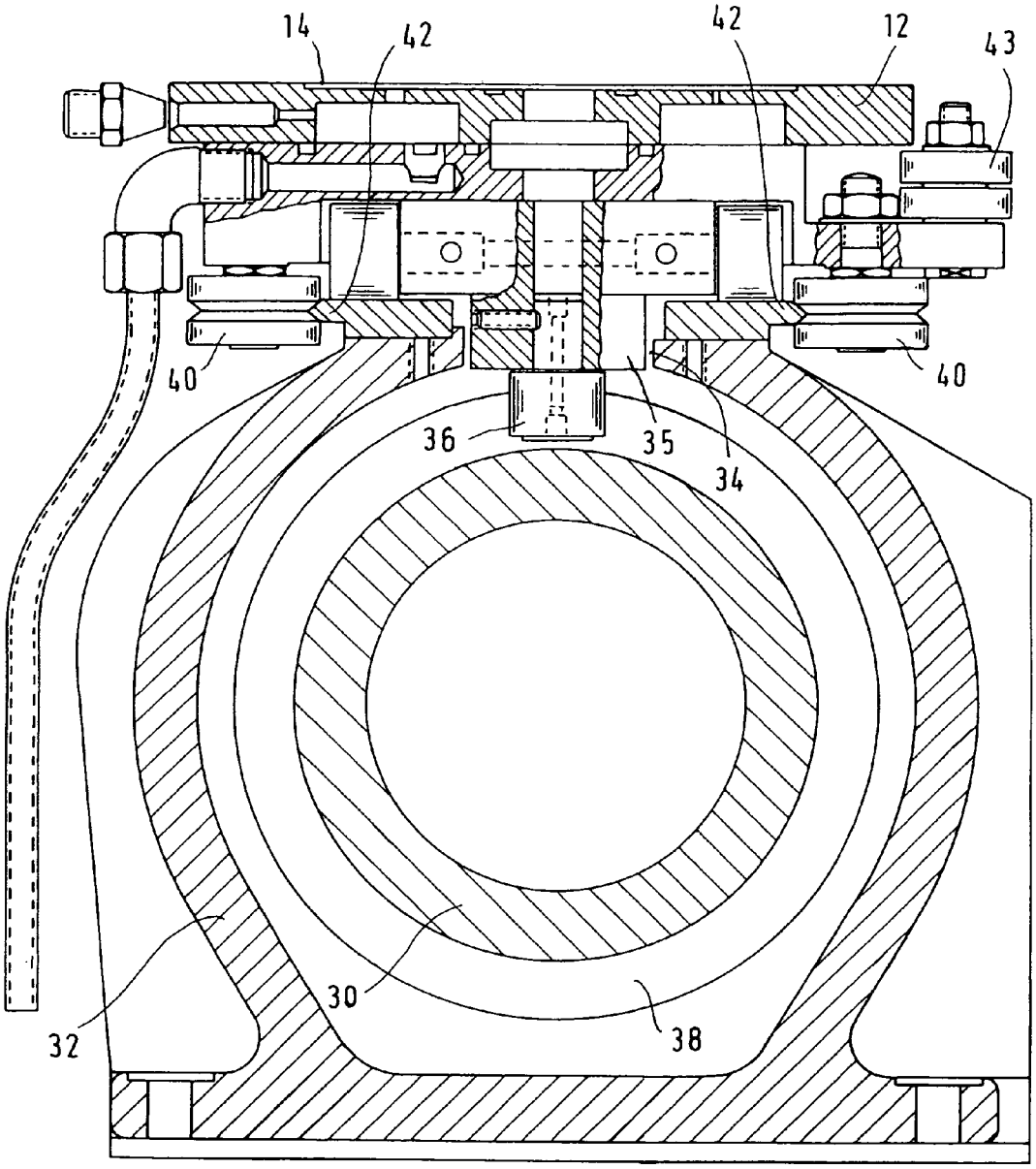
FIG. 3 is a view in section taken along line III—III in FIG. 1.

The machine 10 has a plurality of object carriers 12 which are in the form of carriages and each of which is provided on its top side with a receptacle indicated at 14 in FIGS. 2 and 3, for an object indicated at 16 for example in FIG. 1.

The object carriers 12 are movable in the direction of the arrow 18 in FIG. 1, along a transport path identified by reference 20 in FIGS. 1 and 2. The transport path 20 comprises two linear portions 22, 24 arranged at a horizontal spacing from each other and two substantially semicircular portions 26, 28 which interconnect the two linear portions 22, 24.

Associated with each of the two linear portions 22, 24, for transporting the object carriers 12 along the transport path 20, is a transport screw which is diagrammatically shown in section at reference 30 in FIG. 3 and which is arranged within an approximately cylindrical housing indicated at 32 also in FIG. 3. As shown in FIG. 2, associated with each of the two semicircular portions 26, 28 is a respective drive wheel 33, which rotates in a horizontal plane, but which is only diagrammatically indicated in the drawing. The respective drive wheel 33 can rotate continuously or discontinuously and provides for transport of the object carriers 12 in the two semicircular portions 26, 28 of the transport path 20.

Looking now again at FIG. 3, in the region of its upper apex the housing 32 is provided with a passage 34 which extends in the longitudinal direction of the transport screw 30 and through which extends an extension 35 projecting downwardly from the underside of the object carrier 12. Mounted rotatably to the projection 35 is at least one entrainment roller 36, the axis of rotation of which extends substantially radially with respect to the transport screw 30 and which is in engagement with a screw flight 38 thereon, in such a way that the co-operation of the entrainment roller 36 and the screw flight 38 implements transport of the object carrier 12 along the transport path 20 with a high degree of precision, while the position of the respective object carrier 12 can be accurately defined in the course of the transport movement, along the transport path 20. It will be appreciated that the transport screw 30 has at least one screw flight 38 but may also have a plurality thereof if required.

Positioning of the respective object carrier 12, and thus the object carried thereby, in transverse relationship with respect to the direction of transport movement is implemented by four guide rollers indicated at 40 in FIG. 3, which are mounted to the respective object carrier 12 and which are arranged in pairs in such a way that a respective pair of rollers 40 at one side of the object carrier 12 co-operates with one of two guide rails 42 which are mounted to the housing 32 and extend in the longitudinal direction thereof along the passage 34. At their peripheral surfaces the guide rollers 40 are each provided with a V-shaped recess extending peripherally therearound and which is adapted to the cross-section, co-operating therewith, of the respective guide rail 42, so that the guide rollers and rails in that respect also ensure a precisely defined positioning of the object carrier.

The object carrier 12 as shown in FIG. 3 is further provided with a lateral entrainment roller 43 which, on passing along the two semicircular portions 26, 28 of the transport path 20, is in engagement with and is entrained by the respective drive wheel 33.

In regard to the design configuration of the transport path 20 and the object carrier, attention is also directed to above-mentioned U.S. Pat. No. 6,082,256, the entire contents of which are incorporated herein by reference.

Looking now again at FIGS. 1 and 2, the apparatus according to the invention, as illustrated herein, is provided with first and second screen printing stations, indicated generally at A and B, which are both associated with the linear portion 22 of the transport path 20, as can be most clearly seen from FIG. 2. Disposed between the printing stations A and B and associated with the linear portion 22 is a station D in which objects to be printed upon are introduced into the receptacle 14 of a respective object carrier 12 disposed in the station D, and a further station E in which printed objects are removed from the receptacle 14 of the respective object carrier 12 disposed in the station E, after the respective objects have passed through other treatment stations which are not shown here but which are disposed between the station D and the station E and which are arranged similarly along the transport path 20.

The screen printing stations A and B each have a respective screen printing mechanism. The screen printing mechanisms in the stations A and B are of the same design configuration in this embodiment, so that the description hereinafter will be limited to the station A, as also typifying the station B.

Figure 4:
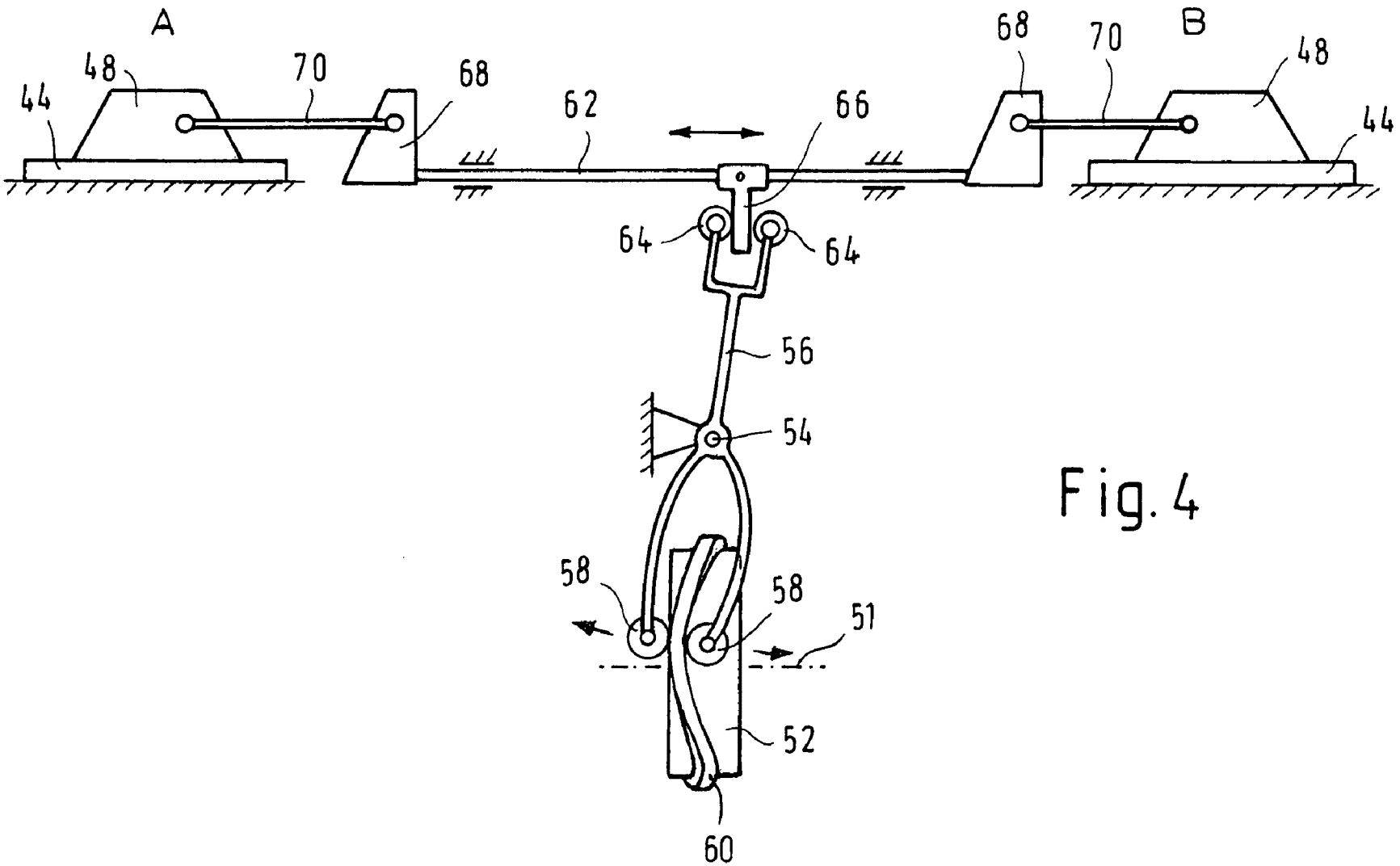
FIG. 4 is a highly diagrammatic view of drive arrangements for screen printing mechanisms of the FIG. 1 machine.
Figure 5:
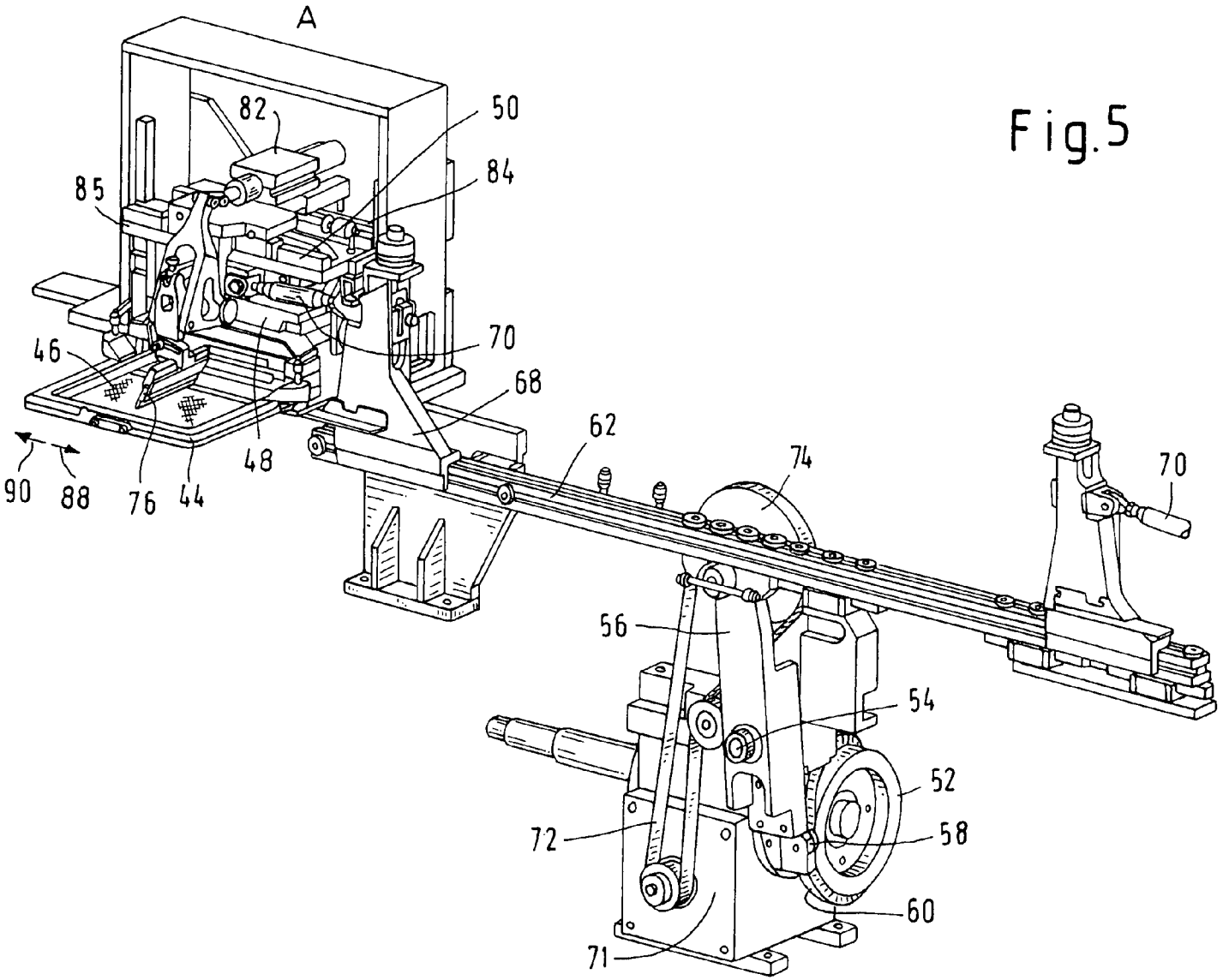
FIG. 5 is a detailed perspective view of part of the arrangement for driving the screen printing mechanisms.

Referring now to FIGS. 4 and 5, each printing station is provided with a screen printing stencil carriage 48 carrying the stencil frame 44 with the screen printing stencil 46. The carriage 48 is reciprocable on guides 50 in parallel relationship with the course of the linear portion 22 of the transport path 20. Accordingly, the screen printing stencil 46 is also displaceable in the direction in which an object carrier 12 with an object 16 thereon is movable along the linear portion 22 by the associated transport screw 30. In that respect an aspect of crucial significance is that, during a printing operation, the movements of the object 16 on the one hand and those of the stencil 46 on the other hand take place in synchronous relationship, so that the decoration applied to an object by printing or some other application implemented by a screen printing process on the object complies with the quality requirements which are usually imposed nowadays.

Looking now at this part of the apparatus in greater detail, the arrangement is such that associated with the screen printing mechanism of each of the two stations A and B is a common cam disk 52, which can be seen in its general context in FIG. 5 and in somewhat more detail in FIG. 4. The cam disk 52 is rotatable about an axis indicated at 51. Co-operating with the cam disk 52 is a swing lever 56, which is reciprocable about a horizontal axis 54 extending perpendicularly to the linear portion 22 of the transport path 20. Near its lower end in FIGS. 4 and 5 the swing lever 56 carries first and second cam rollers 58, each of which bears against a respective side of the cam portion 60 on the cam disk 52, as can be seen more specifically from FIG. 4.

Arranged between the carriages 48 of the two screen printing stations A and B is a thrust rod 62 which is supported reciprocably on the support frame structure of the machine. The thrust rod 62 extends parallel to the linear portion 22 of the transport path 20.

The upper end region of the swing lever 56 is connected to the thrust rod 62 intermediate the ends thereof in such a way that the reciprocating movements of the swing lever 56 about the pivot axis 54 are transmitted to the thrust rod 62 so that the thrust rod 62 is entrained by the swing lever 56. To illustrate the connection between the upper end region of the swing lever 56 and the thrust rod 62, as diagrammatically shown in FIG. 4, the swing lever 56 is provided at its upper end region with first and second rollers 64, which are each rotatable about a respective axis parallel to the pivot axis 54 and which co-operate with a close fit with a vertical guide bar 66 mounted to the thrust rod 62 intermediate the ends thereof.

Each end of the thrust rod 62 is connected to a respective carriage 48 with the interposition of an adjusting device 68 and by way of a coupling rod 70. The adjusting device 68 and the coupling rod 70 also perform the function of making the respective carriages 48 adjustable relative to the thrust rod 62, in order in that way to be able to afford the respectively correct relative basic position of the carriage 48 and thus the screen printing stencil 46 carried thereby relative to the object 16 to be printed upon.

As can be seen from FIG. 5 the cam disk 52 is driven in rotation at a preferably constant speed by way of a cylinder transmission 71 which in turn is driven by a toothed belt 72. The toothed belt 72 is driven by a drive pulley 74, which is preferably driven in rotation by the same motor as that by which the transport screws 30 are also rotated. It will be noted in this respect that the cam portion 60 on the cam disk 52 can have a configuration corresponding to that of the screw flight of the drive screw in the region of the respective printing stations A and B. It will be appreciated that the transmission action afforded by the swing lever 56 is to be taken into consideration in this respect. Although, as stated hereinbefore, it is generally more desirable for the drive for the transport screw and the drive for the screen printing stencils to be afforded by the same electric motor, having regard to the aim of achieving a synchronous relationship between the movements of the object and the screen printing stencil for printing thereon, it is also possible to use two separate motors for that purpose, in which case the motors will have to be controlled in such a way as to ensure the required synchronous movements of the objects and the stencils.

Figure 6:
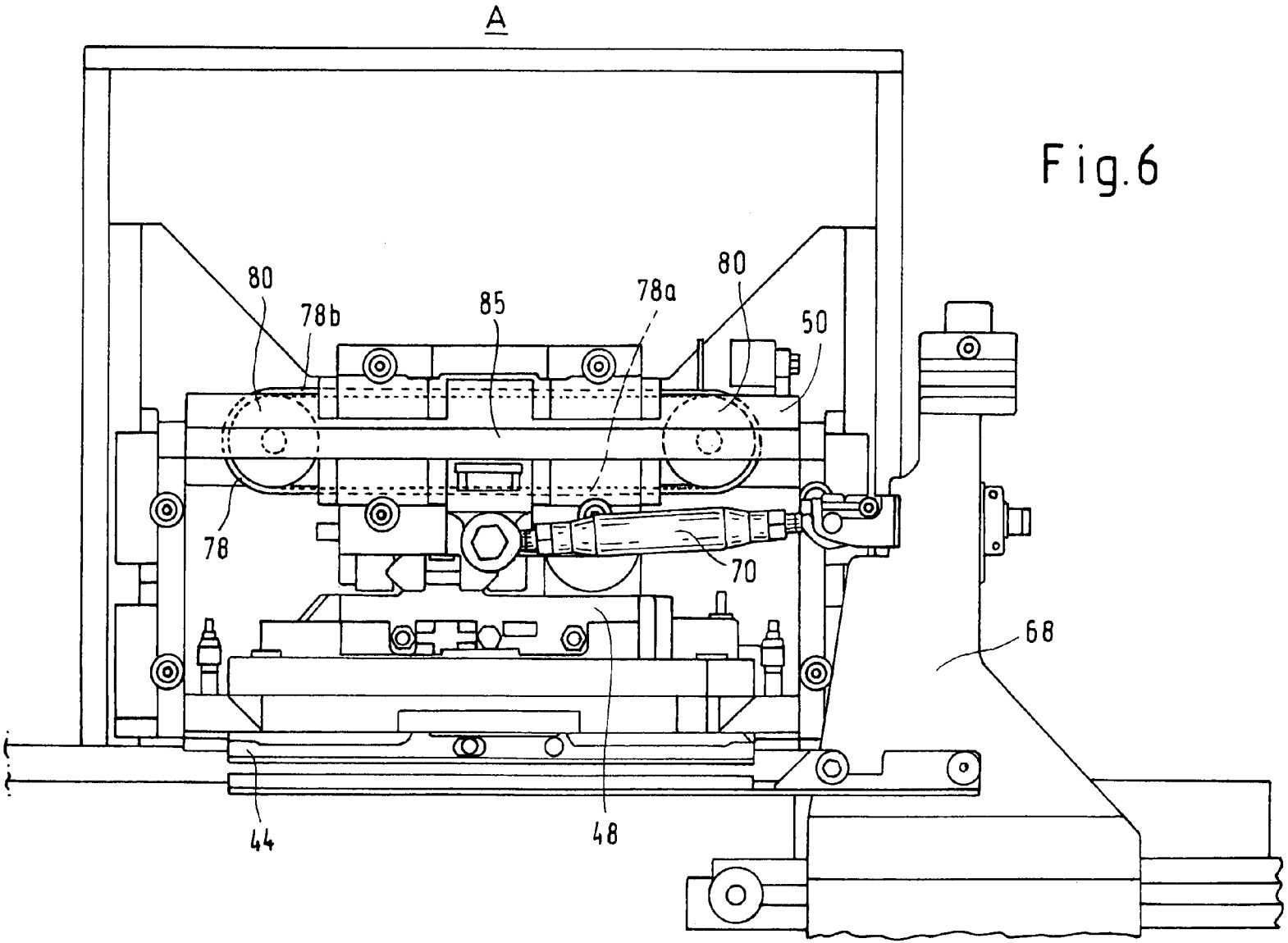
FIG. 6 is a front view of a screen printing mechanism of the machine.

While the object to be printed upon and the screen printing stencil to apply the printing thereto are moved synchronously during the printing operation, a doctor indicated at 76 in FIG. 5, which is associated with the respective screen printing stencil 46, is moving in opposite relationship to the screen printing stencil 46. For that purpose, each screen printing mechanism includes a toothed belt, which is identified by reference 78 in FIG. 6 and which is guided around two direction-changing and guide pulleys 80 in such a way that the portions of the toothed belt 78, which are between the pulleys 80, extend substantially horizontally and are disposed in a vertical plane. FIG. 6 further shows that the screen printing stencil carriage 48 is connected to the lower one 78*a* of the two toothed belt portions extending between the pulleys 80, so that the toothed belt is entrained by the carriage 48 and is reciprocated in accordance with the movements of the latter.

The doctor 76 is carried by a carriage 82 which is guided on a guide indicated diagrammatically at 84 in FIG. 5 of the respective screen printing mechanism in parallel relationship with the direction of movement of the object 16 in the respective printing station. The doctor is connected to the upper portion, as indicated at 78*b* in FIG. 6, of the toothed belt 78, so that it is entrained by the toothed belt 78. By virtue of the described arrangement, the doctor 76 produces reciprocating movements which are in opposite relationship to those of the screen printing stencil carriage 48. The guides for the screen printing stencil carriage 48 and the doctor carriage 82 are mounted to a fixed component part 85 in FIG. 6 of the respective screen printing station.

Figure 7A:
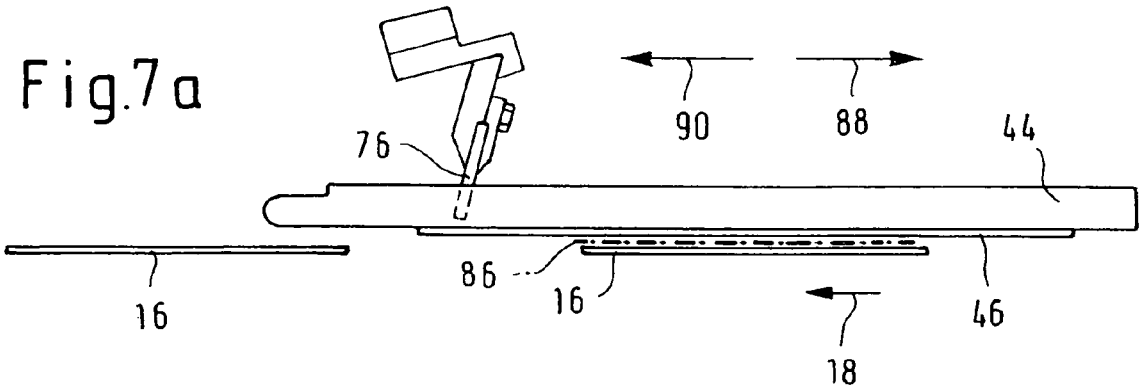
FIGS. 7*a* through 7*g* are greatly simplified views illustrating the operating procedure involved in a working cycle in six successive operating positions of the machine.
Figure 7B:
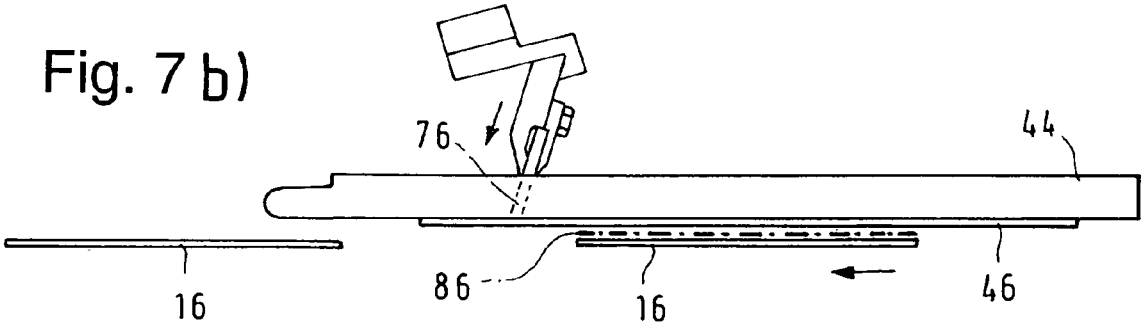
Figure 7C:
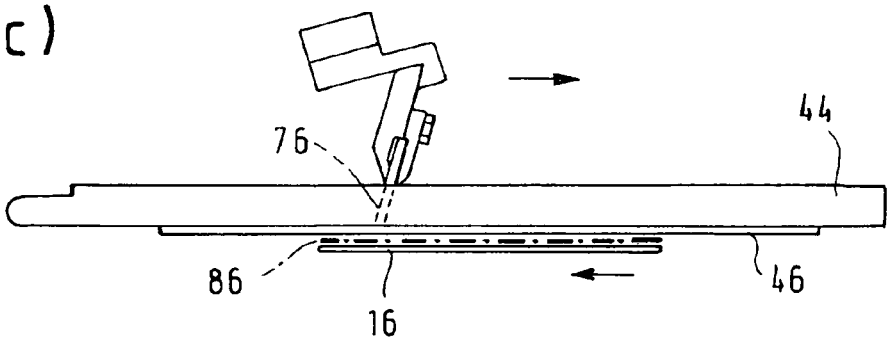
Figure 7D:
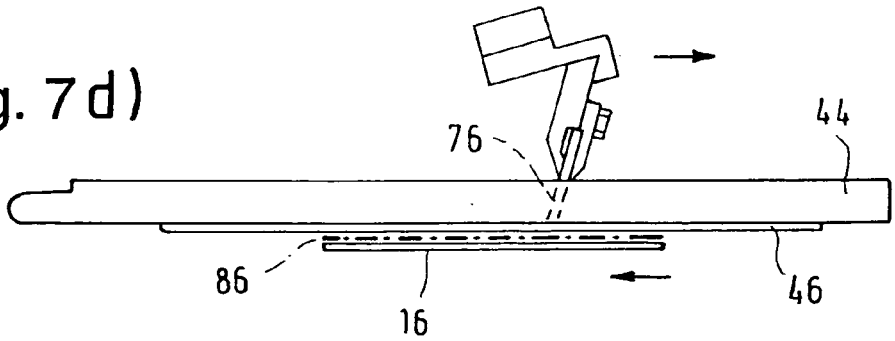
Figure 7E:
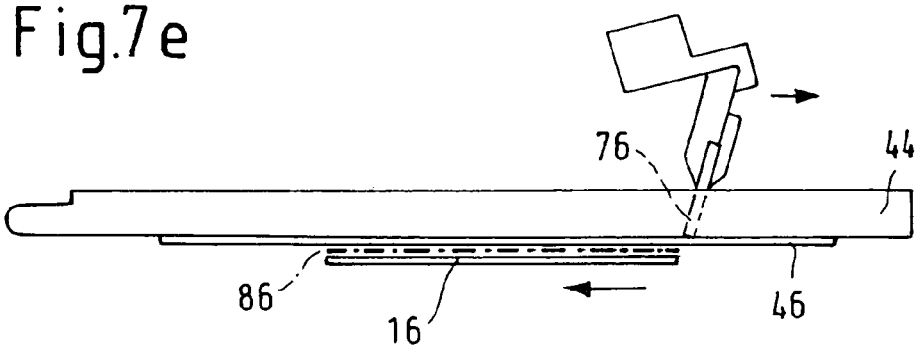
Figure 7F:
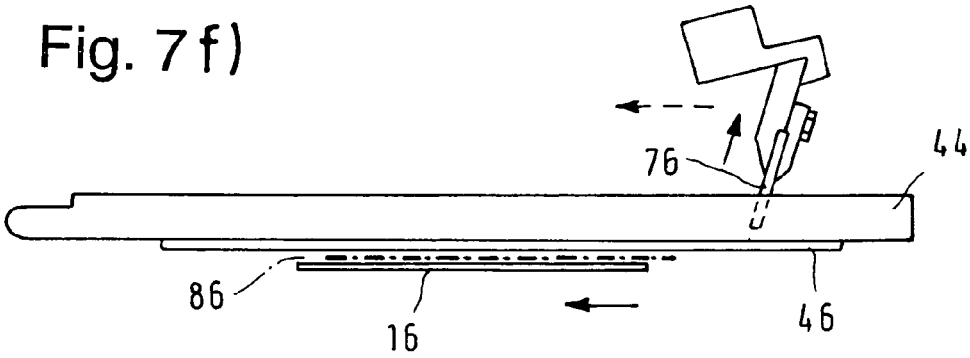
Figure 7:
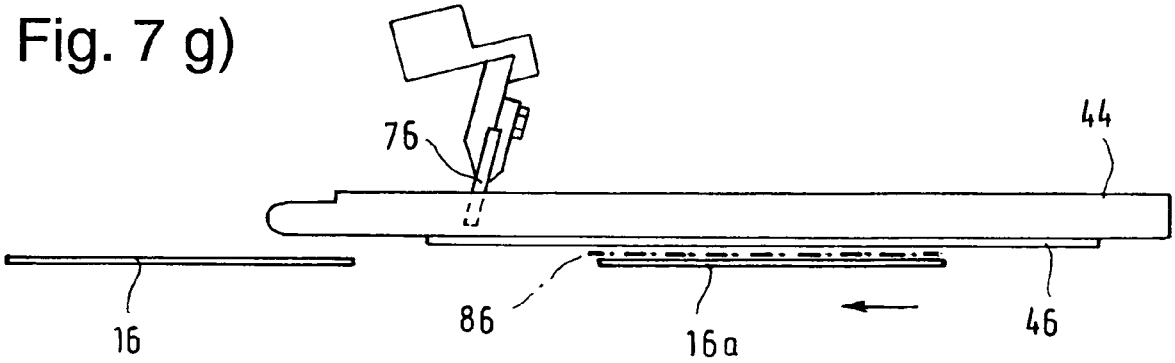

Reference will now be made to FIG. 7 and more specifically FIGS. 7*a* through 7*g* to describe the co-operation of the screen printing stencil, the doctor and an object in the course of a printing operation. For illustration purposes a print image, which is incorporated into the screen printing stencil 46, is shown separately immediately beneath the screen printing stencil 46, so that it can be better seen, and is identified by reference numeral 86. It is assumed in this respect that the outside dimensions of the print image 86 approximately correspond to those of the object 16 to which the print image 86 is to be applied, although that would not always have to be the case. In all the views in FIGS. 7*a* through 7*g* the object 16 is disposed in the respective receptacle 14 of an object carrier 12, beyond which it appropriately projects slightly upwardly.

At the beginning of the illustrated operating cycle in the position shown in FIG. 7*a*, the screen printing frame 44 with the stencil 46 and the doctor 76 are each in the right-hand and left-hand limit positions, respectively, and are thus in the starting position for a working cycle in which the CD 16 disposed underneath the stencil 46 is to be printed upon. FIG. 7*a* therefore shows the position of the screen printing stencil both after the end of the return stroke movement, which takes place in the direction indicated by the arrow 88, and prior to the commencement of the following working stroke movement in the direction of the arrow 90, in the course of which decoration or printing is applied to the CD.

The doctor 76 is also disposed in its starting position for the next working cycle, after the end of its return stroke movement in the direction indicated by the arrow 90, the doctor 76 still being positioned at a spacing above the stencil 46. At that moment in time the print image 86 in the screen printing stencil, on the one hand, and the CD to be printed upon, on the other hand, are not yet in precisely aligned relationship since, as FIG. 7*a* clearly shows, the CD 16 is still slightly displaced relative to the print image 86 in the direction of the arrow 88, that is to say, in an opposite relationship to the transport direction 90.

Referring now to FIG. 7*b*, shown therein is the position of the parts of the apparatus shortly after the commencement of a working cycle. In comparison with the starting position as shown in FIG. 7*a*, the screen printing stencil 46 is displaced by a distance towards the left and the doctor 76 is displaced by the same distance towards the right. In that situation the doctor 76 can already be lowered onto the screen printing stencil 46. FIG. 7*b* further shows that the object 16 and the print image 86 in the stencil 46 are in precisely coincident relationship and thus, in the movement of the parts of the apparatus from the position shown in FIG. 7*a* into the position shown in FIG. 7*b*, the object 16, in this case the CD, was moved by the transport screw 30 relatively somewhat faster in order to compensate for the difference which is still to be found in the position shown in FIG. 7*a*, in relation to the positions of the object 16 and the print image 86 respectively. When the doctor 76 is lowered, the stencil 46 is pressed somewhat downwardly until it contacts the object 16, although this is not shown in the drawing here.

The movement of the screen printing stencil 46 from the position shown in FIG. 7*a* into that shown in FIG. 7*b* serves essentially to accelerate the stencil 46 and the doctor 76 from a stopped condition. The distance by which the stencil 46 moves between the position shown in FIG. 7*a* and the position shown in FIG. 7*b* corresponds to what can be referred to as the run-up, in other words, that distance which is required to accelerate the screen printing stencil 46 and the doctor 76 to the minimum speed required for the printing operation, and to lower the doctor 76 from a raised position as shown in FIG. 7*a*, in which it is not in contact with the screen printing stencil 46, into a position in which the doctor 76 bears against the stencil 46 and presses it against the object.

Reference will now also be made to FIG. 7*c*, insofar as the phase of accelerating the stencil 46 in the direction indicated by the arrow 90, in for example FIG. 7*a*, and the doctor 76 in the direction of the arrow 88 continues beyond the position of FIG. 7*b* until the position of FIG. 7*c* is reached. It is at that position that the acceleration phase is terminated, and a phase of constant speed of the stencil 46 and the doctor 76 begins. That phase continues until the position shown in FIG. 7*d* is reached, and then the cycle makes the transition into a deceleration phase until the condition of final stoppage is reached, corresponding to the position of FIG. 7*f*, in which the stencil 46 together with the doctor 76 have each attained their second end position.

In that respect, the printing operation lasts during the deceleration phase which begins at the position shown in FIG. 7*d* until the position of FIG. 7*e* is reached. Thereafter, the doctor 76 is raised and moved out of engagement with the stencil 46. This therefore is the position shown in FIG. 7*f*. The remaining travel distance between the positions of FIGS. 7*e* and 7*f* is the run-down which is associated with the second end of the stencil. The run-down is required to decelerate the movements of the stencil 46 and the doctor 76 in the second end position, as shown in FIG. 7*f*, until the stopped condition is reached.

The above-described drive arrangement in the apparatus according to the invention provides that the doctor 76 is moved by way of the toothed belt 78 synchronously, although in an opposite relationship with the stencil 46, and the actual printing operation takes place when the doctor 76 is in contact with the stencil 46 and above the respective object 16 to be printed. It is possible to make a distinction between three phases during the printing procedure, more specifically a first phase which begins shortly after the position shown in FIG. 7*b* is reached until the position of FIG. 7*c* is reached, in which the stencil 46 is accelerated in the direction of the arrow 90 and the doctor 76 is accelerated in the direction of the arrow 88. For that purpose, corresponding acceleration of the object 16 is required in the direction of the arrow 90 in order to achieve a condition of synchronism with the movement of the stencil 46.

It will be appreciated that the requirement for synchronous movement, as between the stencil 46 and the object 16, applies in respect of the entire printing operation so that, even in the constant-speed phase which begins approximately at the position shown in FIG. 7*c* and in the concluding printing phase from FIG. 7*d* to FIG. 7*e* at decreasing speed, the object 16 must be moved in a corresponding fashion. This means that the transport screw 30 which moves the respective object carrier carrying the object 16 in question is provided with a thread flight which is of a configuration corresponding to the speeds that are required during the various phases of the printing operation. It is assumed in that respect that the transport screw 30 rotates at a constant speed in the operation of the apparatus.

After the position shown in FIG. 7*e* is reached, the doctor 76 is lifted off the stencil 46 again, so that the stencil 46 also comes out of engagement with the object 16, which has now been printed upon.

FIG. 7*f* shows that the speeds of the stencil 46, on the one hand, and the object 16 which has just been printed upon, on the other hand, are already no longer the same prior to termination of the stroke movement of the stencil 46 in the direction of the arrow 90. Thus, the object 16 is displaced somewhat in the transport direction 90 with respect to the print image 86 in the stencil 46, and therefore in the last phase has moved faster than the stencil 46.

After the second end position shown in FIG. 7*f* is reached, the stencil 46 and the doctor 76 are moved back again into the respective starting positions shown in FIG. 7*g* (the same as in FIG. 7*a*), corresponding to the first end position. In the meantime, the following object carrier with the next respective object 16*a* has arrived at the printing station, and that object will then be printed upon in the above-described manner in the following working cycle.

The movement of the stencil 46 during the printing stroke movement is optimized in relation to the throughput capacity of the printing station and the quality of the print image produced, in such a way that the stencil and the object, on the one hand, and the doctor 76, on the other hand, are moved at a substantially constant speed over between about 40 and 45% of the printing travel distance. Accordingly, between 55 and 60% of the printing travel distance is allocated to the acceleration phase at the beginning of the printing procedure and the deceleration phase at the end of the printing procedure, those two phases preferably being of at least approximately equal length.

The sequence of movements of the objects, and therewith the object carriers accommodating same, which occurs in the printing stations A and B, can be readily incorporated into operating procedures which arise out of other conditions of operation of the apparatus. Thus, for example, the respective object carrier in the input station D will be stationary for a certain period of time for the purposes of receiving a fresh object to which printing is subsequently to be applied. In any case, that is to say irrespective of the operating requirements in the screen printing station A, acceleration of the object is required, starting from the input station D, and that can be readily followed by the acceleration phase in the screen printing station A. On the other hand, as can be seen from FIG. 2, disposed directly downstream of the screen printing station B in the transport direction 18 is a checking station F for checking the quality of the print image applied to each respective article. In station F the object carriers with their respective object come to a halt, so that here it would be possible for deceleration of the transport speed in the last printing phase to be continued until the object carriers come to a halt in the station F.

It will be noted that, in the embodiment illustrated in the drawings, rotary printing stations indicated diagrammatically at G, H, K, L in FIG. 2 are associated with the linear portion 24 of the transport path. Stations G, H, K, L are not visible in FIG. 1. It will be appreciated, however, that it is also possible for at least one screen printing station to be operatively associated with the linear portion 24, which may also be provided with a suitable transport screw. In that case, the foregoing description relating to the stations A and B will, correspondingly, also apply to the further screen printing station associated with the linear portion 24. It will further be appreciated that it is also possible for the apparatus to be provided exclusively with screen printing stations.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for decorating inherently stiff objects using at least a screen printing process, comprising a transport path in the apparatus, at least one screen printing station on the transport path, object carriers for carrying respective objects along the transport path, at least one screen printing stencil in the at least one screen printing station, a drive operable during a printing operation to advance the object carriers with objects carried thereby and the at least one screen printing stencil synchronously along the transport path, the drive for the object carriers including, at least in a region of the at least one screen printing station, a transport screw with at least one screw flight engageable with the object carriers, a doctor co-operable with the at least one screen printing stencil, means for moving the doctor in the printing operation in an opposite relationship to a direction of movement of the at least one screen printing stencil and the object carriers, and means for actuating the drive for the object carriers and the at least one screen printing stencil during the printing operation to cause the object carriers with respective objects and the at least one screen printing stencil to pass synchronously through at least an acceleration phase and a deceleration phase, such that a printing stroke movement of the at least one screen printing stencil is less than a total stroke movement thereof in the direction of movement of the object carriers.

2. The apparatus as set forth in claim 1, wherein the means for actuating the drive for the object carriers and the at least one screen printing stencil are operable during the printing operation to implement, between the acceleration phase and the deceleration phase, a phase in which the object carriers with respective objects and the at least one screen printing stencil are moved synchronously at a constant speed.

3. The apparatus as set forth in claim 1, further comprising means for rotating the transport screw at a constant speed.

4. The apparatus as set forth in claim 1, wherein the drive for the at least one screen printing stencil includes a cam, and a transmission drivingly connecting the cam to the at least one screen printing stencil.

5. The apparatus as set forth in claim 4, wherein the stencil drive includes a swing lever, the cam being operable to transmit reciprocating movements to the swing lever, at least one carriage carrying the at least one screen printing stencil, and means drivingly connecting the swing lever to the carriage.

6. The apparatus as set forth in claim 5, further comprising a thrust rod connecting the swing lever and the respective stencil carriage.

7. The apparatus as set forth in claim 6, wherein the swing lever is connected to the thrust rod intermediate first and second ends of the thrust rod, and each end of the thrust rod is connected to a respective stencil carriage.

8. The apparatus as set forth in claim 1, further comprising means for driving the means for moving the doctor from the drive for the at least one screen printing stencil.

* * * * *